US005085438A

United States Patent [19]

Takeno

[11] Patent Number: 5,085,438

[45] Date of Patent: Feb. 4, 1992

[54] GOLF TEE

[75] Inventor: Katsuji Takeno, 15-47, Nagayoshi Deto 6-chome, Hirano, Osaka, Japan

[73] Assignee: Katsuji Takeno, Osaka, Japan

[21] Appl. No.: 500,893

[22] Filed: Mar. 29, 1990

[30] Foreign Application Priority Data

Mar. 30, 1989 [JP] Japan ..... 1-82350

[51] Int. Cl.[5] ..... A63B 57/00

[52] U.S. Cl. ..... 273/212; 273/33; 273/DIG. 24

[58] Field of Search ..... 273/33, 202-212, 273/DIG. 24

[56] References Cited

U.S. PATENT DOCUMENTS

| | | | |
|---|---|---|---|
| 716,645 | 12/1902 | Ransom | 273/DIG. 24 |
| 1,627,012 | 5/1927 | Copeland | 273/209 |
| 1,635,376 | 7/1927 | McIlvaine | 273/210 |
| 1,661,513 | 3/1928 | Swett | 273/210 |
| 1,759,657 | 5/1930 | McLeod | 273/33 |
| 1,815,520 | 7/1931 | McLeod | 273/33 |
| 1,815,521 | 7/1931 | McLeod | 273/33 |
| 1,821,475 | 9/1931 | Miller | 273/33 |
| 1,850,560 | 3/1932 | Middendorf | 273/33 |
| 2,050,402 | 8/1936 | Walsh | 273/DIG. 24 |
| 3,464,703 | 9/1969 | Vallas | 273/DIG. 24 |
| 3,645,537 | 2/1972 | Parenteau | 273/212 |
| 3,709,495 | 1/1973 | Krombein | 273/DIG. 24 |
| 3,884,479 | 5/1975 | Gordos | 273/212 |
| 3,918,719 | 11/1975 | Welch | 273/DIG. 24 |
| 3,954,263 | 4/1976 | Whelan et al. | 273/33 |
| 3,971,560 | 7/1976 | Panosh | 273/DIG. 24 |
| 4,014,541 | 3/1977 | Desmarais | 273/33 |

FOREIGN PATENT DOCUMENTS

| | | | |
|---|---|---|---|
| 4752 | of 1905 | United Kingdom | 273/33 |
| 592318 | 9/1947 | United Kingdom | 273/33 |

*Primary Examiner*—Theatrice Brown

*Attorney, Agent, or Firm*—Birch, Stewart, Kolasch & Birch

[57] ABSTRACT

The golf tee comprising a clay substance which is efflorescent and a resin layer formed on the surface of the substance by applying a resin ultraviolet rays thereto. The resin layer increases the strength of the golf tee but becomes weak when placed in contact with water. The strength of the golf tee is very high, so that it can be easily inserted into a tee area of a golf course. Even though the golf tee is left in the ground, the resin layer is weakened when contacted with water and thereafter, the clay substance effloresces. Therefore, the golf tee does not pollute the environment of a golf course or adversely affect the operation of a lawn mower.

2 Claims, 1 Drawing Sheet

GOLF TEE

BACKGROUND OF THE INVENTION

1. Field of the Invention

The present invention relates to a golf tee.

2. Description of the Prior Arts

Conventionally, a golf tee is formed, for example, by cutting wood or molding a synthetic resin. Such a golf tee does not effloresce or decay. Therefore, if it is left broken and scattered on the tee area or in the vicinity thereof, the tee area becomes polluted with broken and used tees. Such pollution causes problems if they become entangled in a lawn mower.

A golf tee formed by molding and drying clay eliminates the above-described disadvantage because it effloresces even if it is left penetrated in the ground of the tee area. Thus, a golf tee made of clay does not pollute the ground and thus does not become entangled in the lawn mower. Prior to the present application, the applicant proposed such a golf tee which is disclosed in application Ser. No. 200,556 filed on May 31, 1988.

However, needless to say, the strength of the golf tee formed by molding with only clay and drying the molded clay is not very high. Therefore, the golf tee tends to break when the golfer pushes it into the ground in preparation for hitting a ball. If a golf tee made of only clay is thickly formed to increase its strength, it is heavy and in addition becomes difficult to penetrate into the ground.

SUMMARY OF THE INVENTION

Accordingly, it is an essential object of the present invention to provide a golf tee which is high in strength and does not pollute the atmosphere of a golf course.

According to the present invention, the golf tee comprises a clay or clay-like substance which is efflorescent is coated with a resin layer, whereby the synthetic resin is hardened by applying ultraviolet rays thereto. The tee becomes weak when placed in contact with water whereby the clay substance effloresces.

The formation of the resin layer increases the strength of the golf tee which is further increased by irradiation. The irradiated resin layer is weakened when placed in contact with water and the clay-like substance effloresces.

According to the present invention, the golf tee is high in strength and as such, can be easily inserted into the tee ground. Furthermore, even if the golf tee is left in the tee area, the resin layer is weakened by water which causes the clay-like substance to effloresce. Therefore, pollution of the golf course is avoided and the grass cutting operation is not hampered by the presence of rigid pieces of golf tees.

These objects and other objects, features, aspects and advantages of the present invention will become more apparent from the following detailed description of the embodiment of the present invention when taken in connection with the accompanying drawings.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
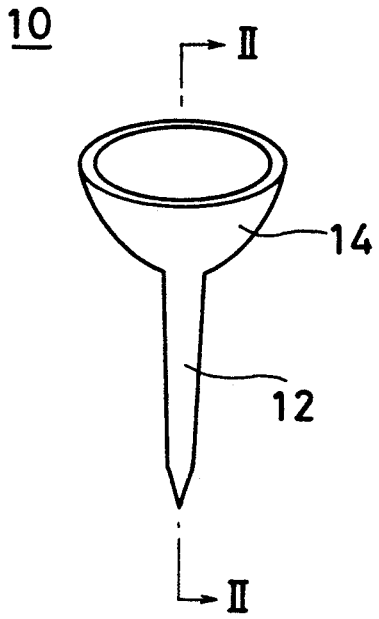
FIG. 1 is a perspective view showing one embodiment of the present invention.
Figure 2:
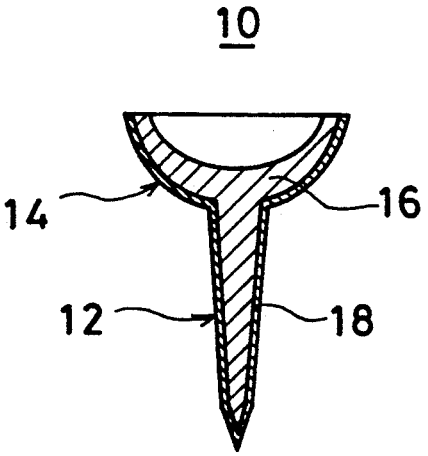
FIG. 2 is a sectional view taken along the lines II—II of FIG. 1.

FIG. 1 is a perspective view showing an embodiment of the present invention and FIG. 2 is a sectional view taken along the lines II—II of FIG. 1. A golf tee (hereinafter referred to as tee) 10 comprises a shaft section 12 which is sharply-pointed and a plate-shaped receiving section 14 for receiving the golf ball. The main component of the tee 10 is principally made of clay 16 which is efflorescent. A binder is added to the clay 16. The clay 16 and the binder are uniformly kneaded. At this time, air contained in the clay 16 is removed therefrom. The removal of air prevents the tee 10 from cracking after it is molded.

Next, the clay 16 is pressed using a mold made of plaster. The molded clay 16 is hardened using a dryer at a temperature of approximately 80° C. for about two hours. The reason why a mold made of plaster is used is because a tee-shaped molded clay can be easily removed therefrom without using, for example, a mold releasing agent.

A resin layer 18 is formed on the tee-shaped molded clay by applying to the surface thereof a synthetic resin which is hardened by applying ultraviolet radiation thereto. The material of the resin, layer 18 is a mixture of, for example, a reactive oligomer, a reactive monomer, an optical initiator, and an antifoaming agent. The resin mixture is applied to the surface of the clay 16, molded and dried. The mixture is then irradiated by ultraviolet rays having the wavelength of 200–400 nm. Consequently, the resin mixture is hardened as a result of a cross-linking of the resin molecules. Thus, the resin layer 18 is formed. The resin layer 18 becomes weak when it has been in contact with water for approximately 24 hours.

When the tee 10 is used, the shaft section 12 thereof is made to penetrate into the tee area of the golf course and a golf ball is placed on the receiving section 14.

The resin layer 18 increases the strength of the tee 10. Therefore, the tee 10 is as strong as tees made of wood or a synthetic resin, i.e., the tee 10 will not break when it is inserted into the ground in preparation for use. Even though the tee 10 is left penetrated in the tee area, water from rain or normal watering procedures weakens the resin layer 18 and the clay 16 effloresces. Accordingly, the tee 10 does not spoil the environment of the golf course. In addition, a lawn mower is not prevented from smooth operation because of the presence of tee's 10 contaminating the mowing operation.

A material consisting of the following substances may be used instead of the clay 16 as used in the embodiment described above to form the tee 10. For example, a clay-like substance consisting of 90 wt% of fine particles such as granite and calcium carbonite mixed with each other, 8 wt% of pulp, 1.5 wt% of synthetic starch such as chemical starch, and 0.5 wt% of a mixture of antiseptic agent and fungicide can be used. These substance are kneaded before they are molded. Therefore, the molded material is dried at 50°~65° C. for approximately three hours until it is hardened. The strength of the tee 10 is adjusted by selecting a desired water content of the pulp. The antiseptic agent and the fungicide prevent the tee 10 from decaying. Thereafter, the resin layer 18 is formed on the surface of the clay-like material thus formed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf tee comprising:

a unitary body having the shape of a standard golf tee and made of a clay material which is efflorescent, and an irradiated synthetic resin layer formed on the surface of said body, said synthetic resin layer being a mixture of a reactive oligomer, a reactive monomer, an optical initiator and an antifoaming agent.

2. A golf tee comprising:

a unitary body having the shape of a standard golf tee made of a clay material which is efflorescent, said clay material comprising fine particles of granite and calcium carbonate, pulp, synthetic starch and an antiseptic agent-fungicide mixture, and an irradiated synthetic resin layer formed on the surface of said body.

* * * * *